US007621008B2

(12) United States Patent
Matsuura et al.

(10) Patent No.: US 7,621,008 B2
(45) Date of Patent: Nov. 24, 2009

(54) BED

(75) Inventors: Yoichiro Matsuura, Hiroshima (JP); Maki Mimura, Hiroshima (JP)

(73) Assignee: Molten Corporation, Hiroshima-shi (JP)

( * ) Notice: Subject to any disclaimer, the term of this patent is extended or adjusted under 35 U.S.C. 154(b) by 512 days.

(21) Appl. No.: 10/569,974

(22) PCT Filed: Apr. 5, 2005

(86) PCT No.: PCT/JP2005/006996

§ 371 (c)(1),
(2), (4) Date: Feb. 28, 2006

(87) PCT Pub. No.: WO2005/097034

PCT Pub. Date: Oct. 20, 2005

(65) Prior Publication Data

US 2008/0189862 A1 Aug. 14, 2008

(30) Foreign Application Priority Data

Apr. 6, 2004 (JP) ..... 2004-111970

(51) Int. Cl.
*A61G 7/015* (2006.01)

(52) U.S. Cl. ..... 5/618

(58) Field of Classification Search ..... 5/613, 5/614, 616, 617, 618, 632
See application file for complete search history.

(56) References Cited

U.S. PATENT DOCUMENTS 3,447,170 A * 6/1969 Spitz ..... 5/722
3,972,081 A * 8/1976 Stern et al. ..... 5/618
4,356,578 A * 11/1982 Clark ..... 5/602
4,669,136 A * 6/1987 Waters et al. ..... 5/601
6,826,793 B2 * 12/2004 Tekulve ..... 5/618
2004/0055088 A1 * 3/2004 Heimbrock et al. ..... 5/618

FOREIGN PATENT DOCUMENTS

| | | |
|---|---|---|
| JP | 62-12324 | 1/1984 |
| JP | 9-19463 | 7/1997 |
| JP | 10-263016 | 10/1998 |
| JP | 2862128 | 2/1999 |
| JP | 2929016 | 8/1999 |
| JP | 2003-159285 | 6/2003 |
| JP | 2003-265543 | 9/2003 |

OTHER PUBLICATIONS

International Search Report dated Jul. 26, 2005 of PCT/JP2005/006996.

* cited by examiner

*Primary Examiner*—Jennifer H Gay
*Assistant Examiner*—Gilbert Y Lee
(74) *Attorney, Agent, or Firm*—Westerman, Hattori, Daniels & Adrian, LLP

(57) ABSTRACT

The bed is equipped with a back lift mechanism and comprises a thigh support mechanism for supporting only the thighs of a user. The bed further comprises cooperative means for performing a thigh lifting action of said the thigh support mechanism in cooperation with the back lift mechanism in back lifting action. The thigh support mechanism has a thigh support member, which has one end, proximal to the waist section of the bed, pivotally mounted on the bed frame to support only the thighs. The thigh support member has a width smaller than that of the bed frame and is provided only at the central region of the width of the bed frame.

9 Claims, 12 Drawing Sheets

BED

TECHNICAL FIELD

This invention relates to a bed having a back lift mechanism for use in homes, hospitals, and other institutions.

BACKGROUND ART

Recent beds for elderly and/or invalid persons are mostly provided with a back lift mechanism that can be driven by an actuator, so that a user can lift the upper half of his body by the back lift mechanism if he has difficulty in lifting the upper half body by himself.

This type of beds includes (1) beds adapted to perform only back lifting operation to lift (incline) the back of the user, (2) beds adapted to simultaneously perform both back lifting operation and knee lifting operation, and (3) beds that utilize a back lift mechanism adapted to perform knee lifting operation first and then back lifting operation, followed by knee lowering operation to lower the knees, in the middle of the back lifting operation, to flatten the knees, before the back is finally lifted (inclined) to a maximum angle of about 70 degrees. See, for example, Japanese Patent Applications Laid Open 2001-29172 (referred to as Patent Document 1), 2004-16558 (Patent Document 2), 2004-16635 (Patent Document 3), and 2004-444 (Patent Document 4).

Beds are often provided on the side frames thereof with side-rails for preventing, for example, the users thereof from falling from the bed, and safety bars for assisting the user to turn out of the bed, as disclosed in Japanese Patent Applications Laid Open 2004-129709 (Patent Document 5) and 2003-52765 (Patent Document 6).

These beds are required to have a structure for suppressing downward slipping of the body of a user caused by a back lifting action and allow the user in a back-lifted condition to sit up on the bedside or turn out of the bed with ease.

However, the mechanism of type (1) mentioned above fails to prevent downward slipping of the body due to the fact that the knees are not lifted in a back lift operation, though it is then easy for him to sit up on the bedside and turn out of the bed when he is in the back-lifted condition. The mechanism of type (2) can prevent downward slipping of the body when the user is in a back-lifted condition by taking advantage of a knee lift mechanism. However, because the mechanism leaves the knees lifted, it forces the user to assume a cramped position under a back-lifted condition, so that the user will have difficulty to sit up on the bedside or turn out of the bed. The mechanism of type (3) also takes advantage of a knee lift mechanism, which, however, forces the user to assume a cramped position up to an intermediate point of the back lifting operation. Further, since the knees are kept lifted at any intermediate inclination angle of the back lift member (the angle referred to as back lift angle) prior to reaching the intermediate point, the user then stays in too unstable a condition to sit up on the bedside or turn out of the bed. In addition, since an appreciably wide region of the bed frame needs to be configured to support knee lifting and leg (calve) lifting actions, it is difficult to effectively cut the weight and cost of the bed. Furthermore, since the knee lifting action is carried out mechanically by the knee lift mechanism that cooperates directly with the rotary members (such as rotary arm 20, leg lift arm 62, and knee lift link 4), forces acting on the links of the rotary members are suddenly reversed near the maximum knee lift angle. As a consequence, small gaps in the rotary members cause irregular motions of the members. A back lift mechanism having such rotary members in direct cooperation with the back lift member requires a bed to have an appropriate height, so that it is difficult to apply it to a low bed.

There is a possibility that some obstacle or a person can accidentally come into a space below a back lift frame. The obstacle or person is then liable to a risk of being trapped under the back lift frame as the back lift frame is returned to an original flat position (in a back-lowering operation). To prevent such trapping of obstacle, a power controller may be used to control the actuator of the back lift mechanism as disclosed in Japanese Patent Application Laid Open 2004-48824 (Patent Document 7), or a limit switch to limit lowering the back lift frame as disclosed in the Patent Document 4 mentioned above. However, such controllers as mentioned above are liable to an erroneous operation or a failure, thereby failing to ensure safety of the beds.

In hospitals and other institutions, beds are generally equipped on the legs thereof with a multiplicity of casters to facilitate transportation of a bed from one room to another. When not in use, the casters are locked by lock mechanisms to make the wheels of the casters not rotatable. To move the bed, the casters are unlocked.

It is necessary to securely fix a bed in a stable condition when the user sits up on the bed or moves from the bed to a wheelchair. To do this, casters having lock mechanisms have been used.

However, since beds are heavy, lock mechanisms for firmly securing casters in a stable condition add to the cost of the casters.

Moreover, since it is necessary to lock multiple casters to fix the bed hazardous bed instability would occur, should one of them were forgotten to be locked.

Regarding this point, Japanese Patent No. 3063392 (Patent Document 8) discloses a bed having legs for fixing the bed and extra legs for adjusting the height of the bed. The extra legs are each provided with casters that can be grounded on the floor in place of the fixed legs when the bed is lifted to a higher level, thereby rendering the bed movable on floor.

Japanese Patent Application Laid Open 2003-237303 (Patent Document 9) discloses a body (bed) which is movable by a multiplicity of casters, the body having: grounding members (legs) underneath the body for immovably supporting the body; and means for changing the height of the wheels of the casters between an "immovable position" at which the lower ends of the wheels are held at the same level as, or higher than, the lowest end of the grounding members, and a "movable position" at which the lower end of the wheels are held lower than that of the grounding members.

However, in the arrangement as described in the Patent Document 8, the casters can be grounded on the floor to make the bed movable while the bed is maintained at a high level, so that the user lying on the moving bed could be scared with a fear of height, and liable to a risk of severe injury such as a bone fracture if the user falls from the bed.

Like the caster locking mechanism mentioned above, the mechanism for grounding the casters (means for changing the height of the wheels of the casters) as described in the Patent Document 9 also adds to the cost of the casters.

The present invention is directed to alleviate the prior art problems as mentioned above, based on the ground that, in order to prevent downward slipping of the body of the user in a back lifting action, it is necessary to lift only the groin sections of thighs and not necessary to lift the knees, as is done by an anchor of a wheelchair. It is, therefore, an object of the invention to provide a bed capable of preventing downward slipping of the body of the user in the back lifting action without forcing him to assume a cramped position, and allowing the user in a back-lifted condition to sit up on, and turn out of, the bed with ease. It is another object of the invention to provide a lightweight and cost effective bed having such capability as stated above.

It is a further object of the invention to provide a bed having a back lift mechanism that is free of irregular movements and applicable to a low bed.

It is a still further object of the invention to provide a bed having a relatively simple mechanism that can secure safeguard against trapping an obstacle in the mechanism.

It is a still further object of the invention to provide a structurally simple and cost effective bed that can be moved by casters without giving the user a fear of height or a risk of causing a serious injury to the user in a fall from the bed, while avoiding a risk of forgetting to lock casters as well as a risk of a fall of the user from the bed trying to move from the bed to a wheelchair or turn out of the bed for example.

DISCLOSURE OF THE INVENTION

To accomplish the objects stated above, the invention provides a bed characterized by a thigh support mechanism for supportively lifting only the thighs of a user.

Arranged in this way, the bed can prevent the downward slipping of the body of the user on the bed in a back-lifted condition by supporting his groin sections of the thighs (this supporting action hereinafter referred to as thigh supporting action) and lifts only the groin sections without lifting his knees, so that the bed does not force the user to assume a cramped position and enables him to easily sit up on the bedside or turn out of the bed. The invention enables cutting the weight and cost of the bed having such mechanism.

The bed of the invention may be characterized by comprising cooperative means for performing a thigh lifting action of the thigh support mechanism in cooperation with the back lift mechanism in back lifting action.

This arrangement not only prevents downward slipping of the body of the user on the bed in a back-lifted condition by simply executing a back lifting operation and lifting only groin sections of thighs without lifting the knees, so that the user in a back-lifted condition is not forced to assume a cramped position and can easily sit up on the bedside and turn out of the bed. This arrangement enables cutting the weight and cost of the bed accordingly.

The bed of the invention may be characterized by comprising a thigh support mechanism that includes a thigh support member that has an end section to support the waist of the user (the section referred to as waist side end) pivotally mounted on the bed frame to supportively lift only the thighs of the user, the thigh support member having a width smaller than that of the bed frame and provided only at the center of the width of the bed frame.

As a consequence, the user in the back-lifted condition need not assume a cramped position, and can easily sit up on the bedside or turn out of the bed. The weight and cost of the bed can be easily cut.

The inventive bed may be further characterized in that the cooperative means cooperates with the back lift mechanism in back lifting action to perform not only the thigh support action of the thigh support mechanism, but also the thigh lowering action of the thigh support mechanism that is started in the middle of the back lifting action to return the thighs to a flat position.

Accordingly, the user in a back-lifted condition needs not take a cramped position, and can sit up on the bedside or turn out of the bed more easily.

As an example, a bed of the invention may comprise:

a back lift member (back lift frame 3) having a waist side end pivotally mounted on a bed frame (2) for performing back lifting action;

a back lift drive member (back lift bracket 4) fixedly secured to one end of the back lift member (back lift frame 3), the end proximal to a rotary shaft (3*a*) of the back lift member;

a drive mechanism (linear actuator 6) for transmitting the driving power of a driving power source (motor 5) to the back lift drive member (back lift bracket 4);

a thigh support member drive rod (11) having one end pivotally mounted on the back lift drive member (back lift bracket 4) and the other end abutting on a roller (10) provided on the underside of the thigh support member (thigh support frame 9); and a rod support member (rod support plate 12) having a lower end pivotally connected to the bed frame (2) and an upper end pivotally connected to an intermediate point of the thigh support member drive rod (11).

In this arrangement, the thigh supporting action is carried out mechanically by the thigh support member in cooperation with the back lift drive member via the thigh support member drive rod 11 that is supported at a substantial center thereof by a rotary member (rod support member 12), so that the forces acting on the link sections of these members will not be suddenly reversed, thereby preventing irregular motions of the mechanism. Thus, the mechanism can be easily applied to low beds.

The bed may be further characterized in that the operational angle and operational timing of the thigh support member (9) can be adjusted by appropriately configuring the shape (11*a*) of the abutting surface of the thigh support member drive rod (11) in abutment with the roller (10) mounted on the underside of the thigh support member (9).

Thus, the operational angle and timing of the thigh support member can be set to meet the demands of the user with ease and at low cost.

The bed of the invention may be characterized by comprising:

a back lift member (back lift frame 3) having a waist side end pivotally mounted on a bed frame (2) for performing back lifting action;

a back lift drive member (back lift bracket 4) fixedly secured to one end of the back lift member (back lift frame 3), the end proximal to a rotary shaft (3*a*) of the back lift member;

a drive mechanism (linear actuator 6) for transmitting the driving power of a first driving power source (motor 5) to the back lift drive member (back lift bracket 4);

a thigh support drive member (thigh support drive arm 13) fixedly secured to one end of the thigh support member (thigh support frame 9), the end proximal to the rotary shaft (9*a*) of the thigh support member; and a drive mechanism (linear actuator 15) for transmitting the driving power of a second driving power source (motor 14) to the thigh support member (thigh support drive arm 13).

A bed having this arrangement can also provide substantially the same functions as the one described above.

The bed of the invention may be further characterized by comprising:

a back lift member having a waist side end pivotally mounted on the bed frame for performing back lifting action; and a back lift member drive mechanism capable of forcibly driving the back lift member only in the angularly forward direction in which the angle of the back lift member (back lift angle) increases with respect to the bed frame.

Arranged in this way, in the back lifting action, the back lift member is forcibly driven by the back lift member to increase the back lift angle, but, in the back lowering action, the back lift member can be lowered by the weights of the user and the back lift member without resorting to the driving forces of the back lift mechanism, which prevents the user and/or an obstacle from being trapped under the back lift frame, thereby ensuring safety of the user in a back lowering operation.

The bed may be further characterized by comprising:

a back lift member having a waist side end pivotally mounted on the bed frame for performing back lifting action; and a back lift member drive mechanism capable of forcibly driving the back lift member only in the angularly forward direction with respect to the bed frame while the back lift angle is less than a preset angle, and capable of forcibly driving the back lift member in both the angularly forward and backward directions when the back lift angle exceeds the preset angle.

This arrangement ensures not only safeguard, similarly to that of the foregoing back lift member drive mechanism, against trapping of the user and/or an obstacle during a back lowering action, but also the stability of handrails, and hence of the user holding on to the handrails. Specifically, as the back lift angle becomes less than a preset angle during a back lowering action, the back lift member can be lowered by the weights of the user, mattress, and the back lift member without resorting to the driving force of the back lift member drive mechanism, providing safeguard against accidental trapping of the user and/or an obstacle. On the other hand, as the back lift angle exceeds the preset angle, the back lift member is forcibly driven by the driving force in the angularly forward/backward direction to cause the back lift member drive mechanism and the back lift member to be operably united, enhancing the stability of the handrails and of the user holding on to the handrails.

The bed may be characterized by comprising legs mounted on a mechanism for adjusting the height of the bed frame and casters mounted on the bed frame such that the casters can be grounded in place of the legs when the bed frame is positioned at a low level.

A bed thus arranged is simple in structure and cost effective, and yet movable by caters without scaring the user of the bed or without a risk of causing a serious injury to him if he falls from the bed. A further risk that an attendant forgets locking the casters can be avoided. Moreover, harmful stumbling of the user trying to move from the bed to a wheelchair or turn out of the bed can be prevented.

BEST MODE FOR CARRYING OUT THE INVENTION

The invention will now be described in detail by way of example with reference to the accompanying drawings.

First Embodiment

Figure 1:
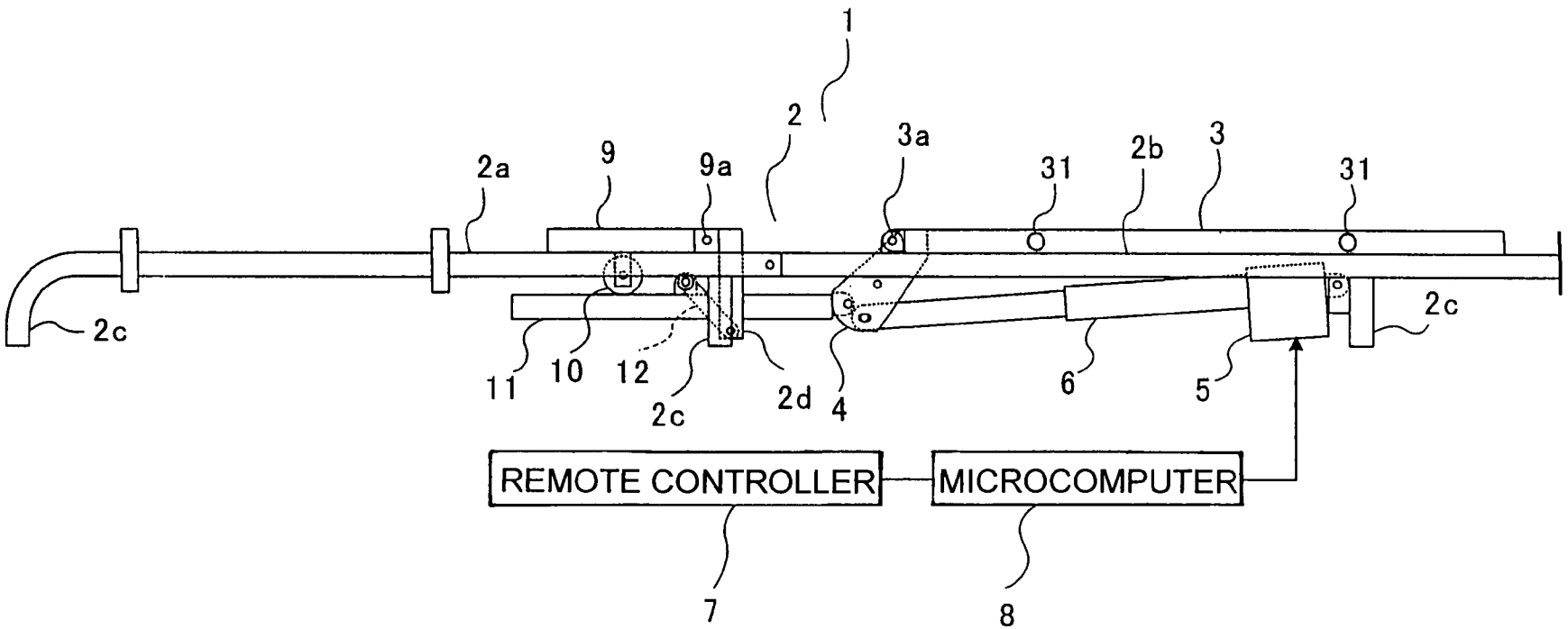
FIG. 1 shows a side elevation of a major section of a bed having a back lift mechanism in accordance with a first embodiment of the invention.
Figure 2:
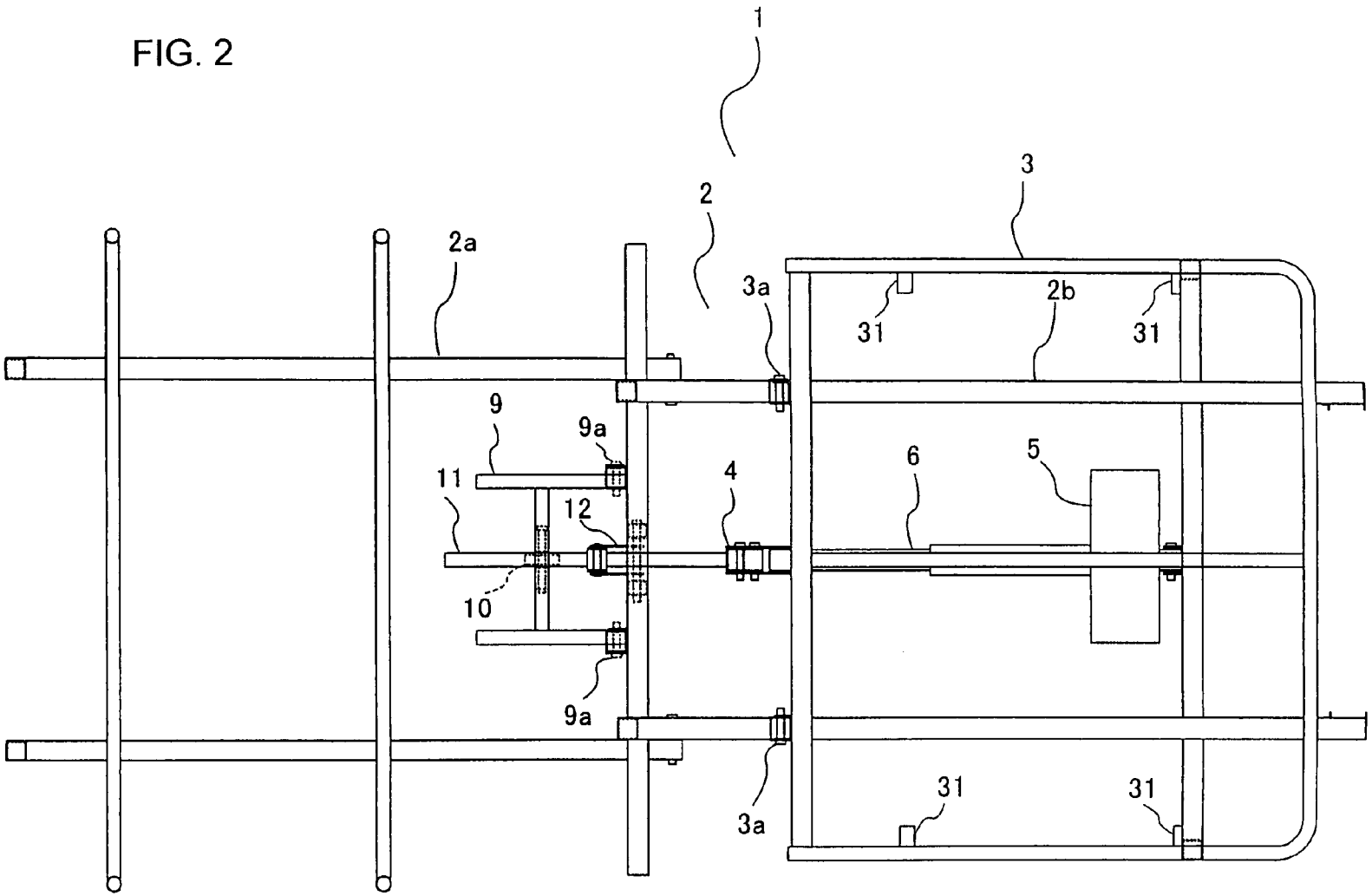
FIG. 2 is a plan view of the bed of FIG. 1.
Figure 3A:
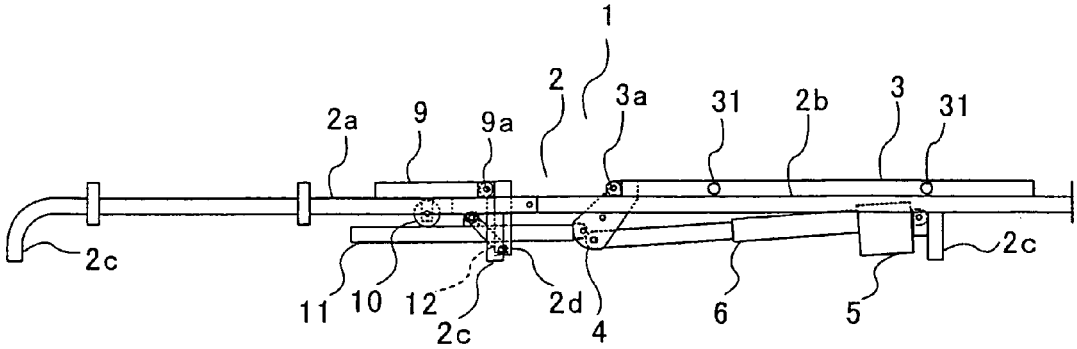
FIG. 3 shows various stages of back lifting operation including thigh supporting operation of the invention.
Figure 3B:
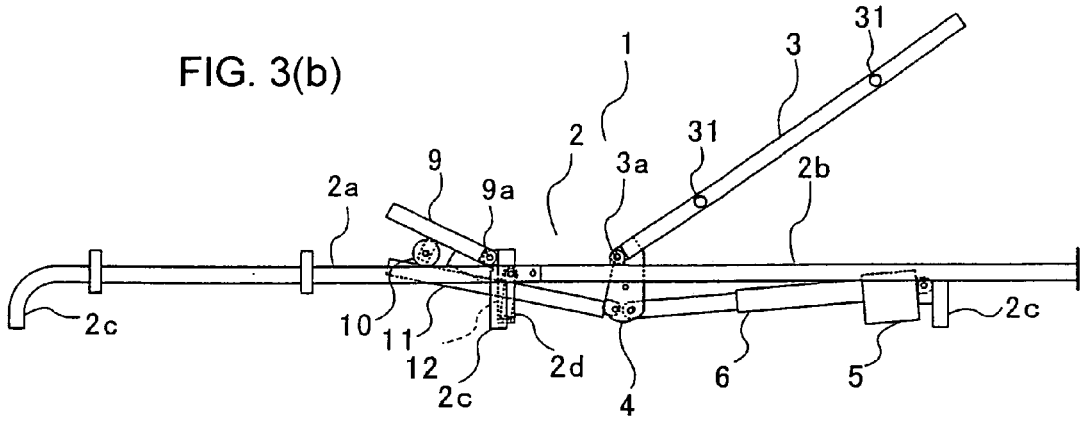
Figure 3C:
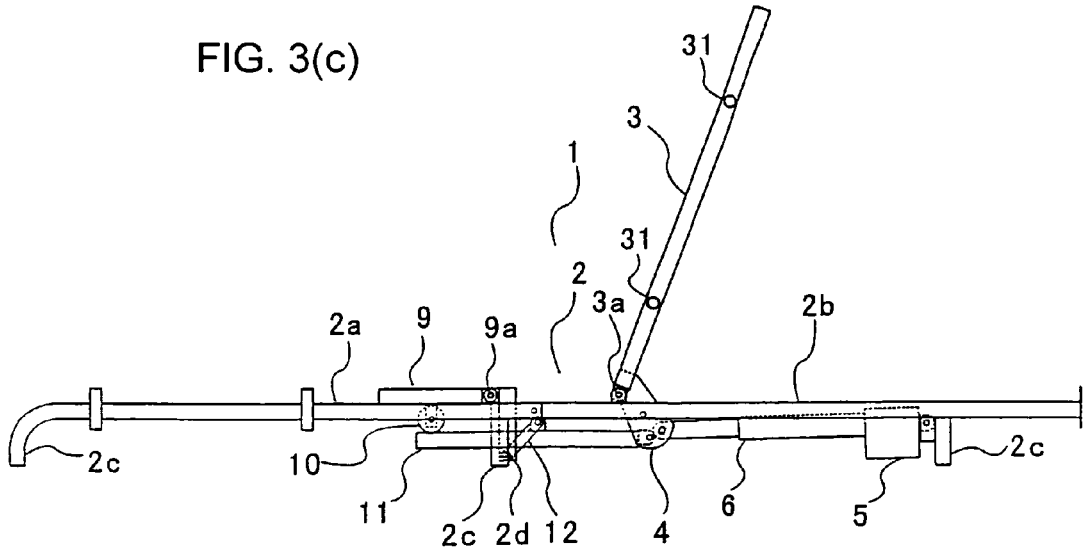
Figure 4:
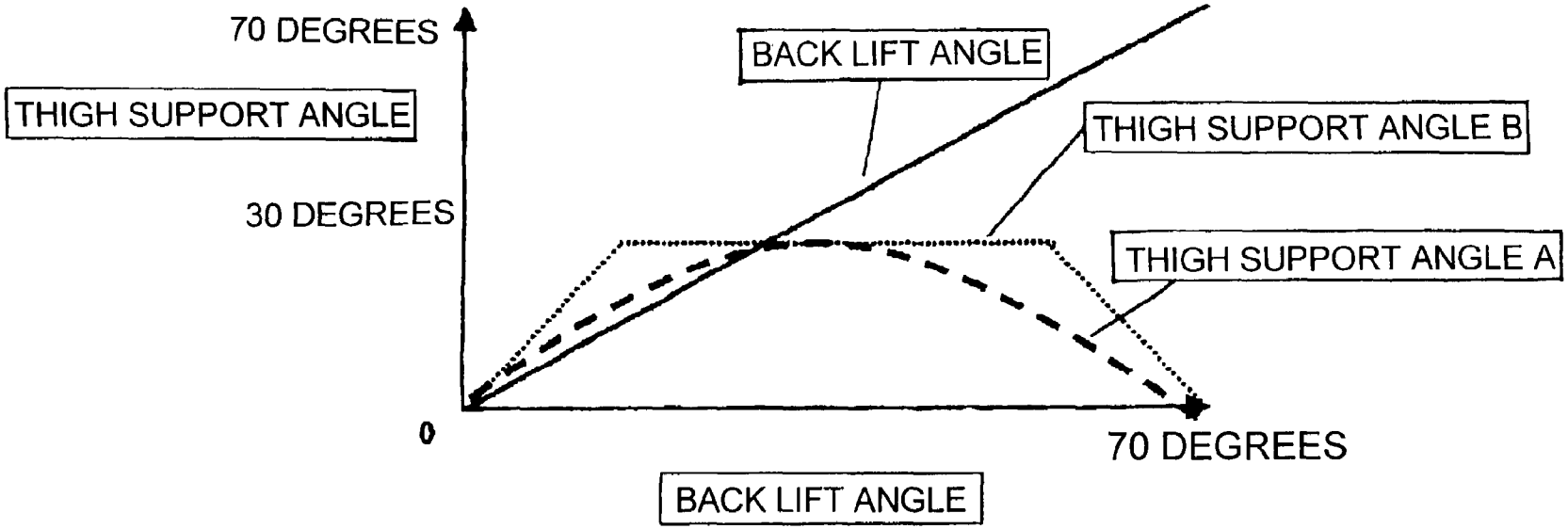
FIG. 4 is a graphical representation of a relationship between the back lift angle and knee thigh support angle associated with the mechanism.

FIG. 1 shows a side elevation of a major section of a bed having a back lift mechanism in accordance with a first embodiment of the invention. FIG. 2 is a plan view of the major section. FIGS. 3(*a*)-(*c*) together show operation of the mechanism. FIG. 4 graphically shows a relationship between the back lift angle and thigh support angle associated with the mechanism.

As seen in FIGS. 1 and 2, the bed frame 2 of a bed 1 having a back lift mechanism is made of square pipes and includes: a foot frame 2*a* (left half section of the frame as seen in the figures) for supporting the lower half of the body below the waist of a user; and a head frame 2*b* (right half section of the frame) for supporting the upper half of the body above the waist. The head frame is detachably coupled to the foot frame by pins. Legs 2*c* are provided at the front, central, and rear sections of the bed frame 2.

Provided on the head frame 2*b* are: a back lift frame (back lift member) 3, made of square pipes and having a waist side end pivotally connected to the head frame 2*b* by means of pins, for performing back lifting action; a back lift drive bracket 4 fixedly secured to the central section of a rotary shaft 3*a* of the back lift frame 3; and a linear actuator 6, pivotally connected to the lower end of the back lift drive bracket 4 to serve as a drive mechanism for transmitting the driving power of a motor 5 when driven in its axial direction. The linear actuator 6 can be a translational ball-screw mechanism consisting of, for example, a threaded shaft and a nut that engages the threaded shaft to undergo a translational motion when driven by the motor 5. The motor 5 can be controlled by a motor drive unit (not shown) and a microcomputer 8 via a remote controller 7. Formed on the side frames provided on the opposite sides of the back lift frame 3 are handrail mounts 31 for mounting thereon handrails (not shown).

On the other hand, pivotally mounted on the foot frame 2*a* is a generally H-shaped thigh support frame (thigh support member) 9 that is made of square pipes and has a width smaller than the width of the foot frame 2*a*, and mounted only in the central area of the width of the foot frame 2*a*. This thigh support frame 9 has a waist side end pivotally mounted on a rotary pin or shaft 9*a* of the foot frame 2*a*. In back lifting operation performed by cooperative means as described below, the thigh support frame 9 supportively lifts only the groin sections of thighs, like an anchor of a wheelchair. The cooperative means is provided with: a thigh support frame drive rod 11 having one end rotatably pinned to the lower section of the back lift drive bracket 4 and another end abutting against a roller 10 that is rotatably mounted on a central region of the underside of the thigh support frame 9; and a rod support plate 12 having a lower end rotatably pinned to a projecting piece 2*d* that depends from the bed frame 2, and an upper end rotatably pinned to a substantially central section of the thigh support frame drive rod 11.

Incidentally, when in use, the bed is provided with, for example, resin plates extending over the back lift frame 3, thigh support frame 9, and bed frame 2 to an extent that does not interfere with the back lift frame 3 or the thigh support frame 9 in operation. A bed mattress is placed on these plates.

Next, referring to FIGS. 3 and 4, operation of a bed equipped with a back lift mechanism arranged in accordance with one embodiment of the invention will now be described. It is noted that FIG. 3(*a*) shows the state of the bed where both the back lift frame 3 and thigh support frame 9 are flattened; FIG. 3(*b*), the state where the linear actuator 6 is contracted by the motor 5 so as to lift the back lift frame 3 to have an inclination angle of about 35 degrees (the angle identified as back inclination angle or back lift angle) to thereby lift the thigh support frame 9 to have an inclination angle (identified as thigh support angle) of about 25 degrees. FIG. 3(*c*), the state where the linear actuator 6 is further contracted by the motor 5 so as to lower (flatten) the thigh support frame 9 to substantially 0 degree while lifting the back lift frame 3 to have a maximum inclination angle of about 70 degrees. In the embodiment shown, it is noted that, as shown in FIG. 4, the inclination angle A (thick broken line) of the thigh support frame 9 varies with the back lift angle (solid curve).

To perform a back lifting action, the user himself or a care worker operates a remote controller 7 to activate the motor 5 so as to contract the linear actuator 6. This in turn causes the lower end of the back lift drive bracket 4 connected to the leading end of the linear actuator 6 to be rotated counterclockwise or downward direction, as seen in FIG. 3, to thereby moving the back lift frame 3 upward. At the same time, the thigh support frame drive rod 11 is pulled by the linear actuator 6, which causes the rod support plate 12, pivotally connected at the upper end thereof to a substantial center of the rod 11 and connected at the lower end thereof to a stationary rotary shaft, to be rotated in the clockwise direction and lifted upward (FIG. 3(*a*)-(*b*)). Accordingly, two counteracting forces are acted on the thigh support frame drive rod 11 by the back lift drive bracket 4 and by the rod support plate 12 such that their small upward or downward motions result in a large inclination angle of the thigh support frame drive rod 11, which in turn causes the thigh support frame 9 to be effectively pushed upward by a roller 10 mounted on the underside of the frame 9.

As the lower end of the back lift drive bracket 4 passes through the lowest point of its circular motion, it undergoes an upward motion. Correspondingly, the top end of the rod support plate 12 undergoes a downward motion as it passes the highest point of its circular path. As a consequence, the inclination angle of the thigh support frame drive rod 11 decreases gradually, and so does the inclination angle of the thigh support frame 9, until the back lift frame 3 reaches the maximum inclination angle of about 70 degrees, at which the thigh support frame 9 returns to the flat position (FIG. 3(*b*)-(*c*)). In the reverse back lowering operation, the above process is reversed.

Thus, according to the embodiment described above, downward slipping of the body can be effectively prevented by the thigh support frame 9 cooperating with the back lift frame 3 when executing a back lifting operation. It is noted that only the groin sections of thighs be lifted, that is, the knees need not be lifted then. Thus, the user is not required to assume a cramped position and can easily sit up on the bedside or turn out of the bed. Furthermore, since the bed needs to be structured to lift only the thighs, the weight and the cost of the bed can be cut accordingly. Thus, the invention can provide a lightweight, inexpensive bed equipped with a back lift mechanism that can prevent slipping of the body of the user in a back lifting operation and allow the user to be free of any cramped position and enables him to sit up on the bedside or turn out of the bed easily.

Furthermore, since the thigh support frame 9 has a width smaller than that of the bed frame 2 and is provided only at a substantial center of the width of the bed frame 2, it not only permits the user to be free of any cramped position in a back lifting operation and enables him to sit up on the bedside and turn out of the bed, but also helps cut the weight and the cost of the bed.

In addition, it is noted that the back lifting operation incorporates not only a thigh supporting action but also a subsequent thigh lowering action that starts at an intermediate stage of the back lifting action. Thus, the user is not forced to take a cramped position thereafter, and, accordingly, he can easily assume a sitting position or turn out of the bed.

Moreover, since the thigh supporting action is mechanically performed by the thigh support member in cooperation with the back lift drive member via the thigh support frame drive rod 11 that is supported at a substantial center thereof by a rotary member (rod support plate 12), forces acting on the link sections of the back lift mechanism will not be suddenly reversed, thereby preventing irregular movements of the mechanism. Thus, the mechanism can be easily applied to low beds.

A bed embodying the invention has such eminent features as described above that it is suitable as a nursing bed equipped with a back lift mechanism for use not only in homes, but also in hospitals and care facilities.

Second Embodiment

Figure 5A:
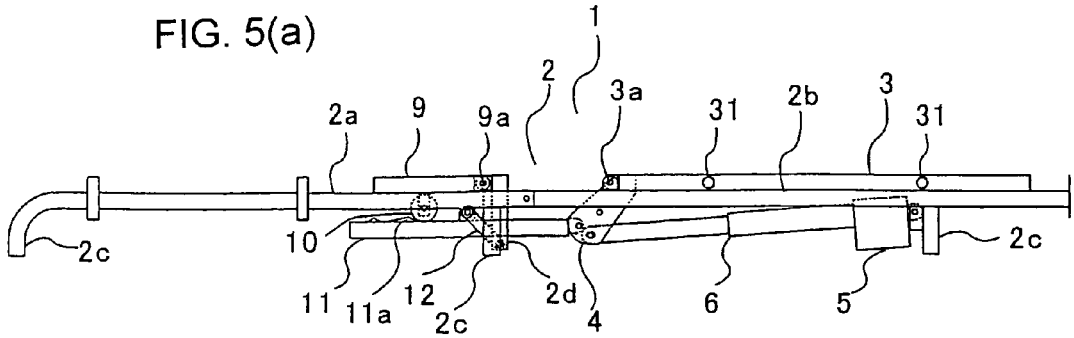
FIG. 5 shows a side elevation of a major section of a bed having a back lift mechanism in accordance with a second embodiment of the invention, showing details and functions of the major section.
Figure 5B:
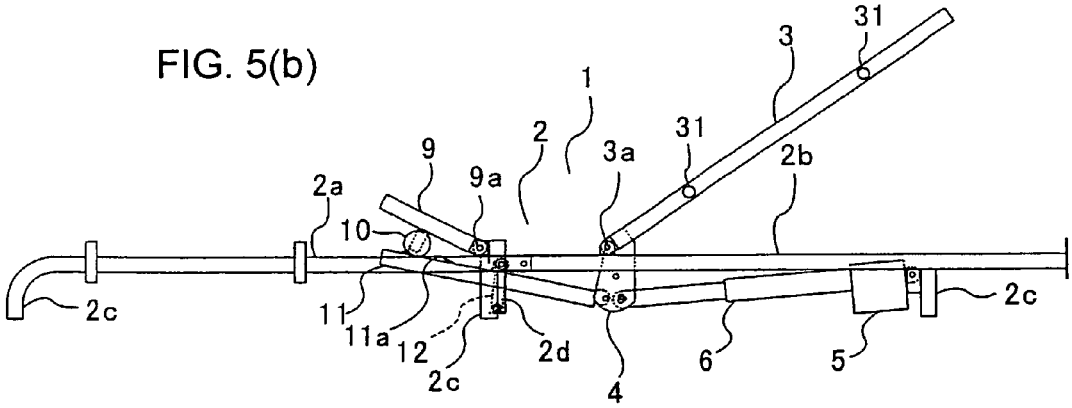
Figure 5C:
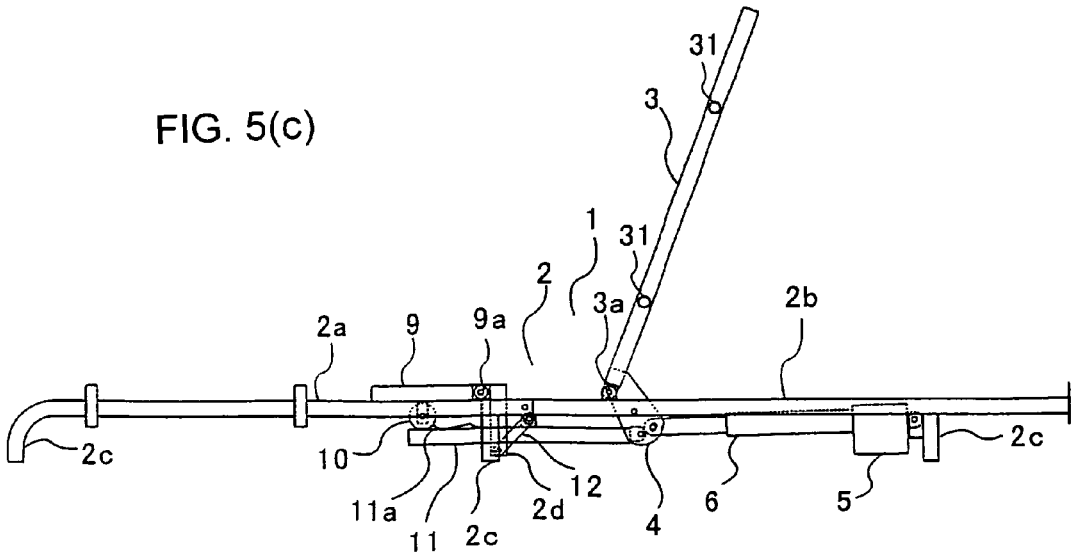

Referring to FIG. 5, there is shown a major portion and functions thereof of a bed having a back lift mechanism in accordance with a second embodiment of the invention, wherein the elements similar to or corresponding to those of the foregoing embodiment are indicated by like or corresponding reference numerals.

In this embodiment, the range of the inclination angle (operational angle) and the timing of the operation (operational timing) of the thigh support frame 9 can be adjusted by changing the shape of the abutment surface of the thigh support frame drive rod 11 abutting against the roller 10 mounted under the thigh support frame 9. In the example shown herein, the thigh support frame drive rod 11 is provided on the roller-abutting surface thereof with an adjustment member 11*a* formed of two smoothly connected bumps each having sharp ridges such that the bumps cancel out upward/downward movement of the rod support plate 12 in the neighborhood of the highest point of the motion thereof, so that, as shown in FIG. 4, the inclination angle of the thigh support frame 9 varies with the back lift angle (solid line), exhibiting a change as indicated by a thin broken trapezoidal curve denoted as "Thigh support angle B".

Thus, the operational angle and the operational timing of the thigh support frame 9 can be easily set at low cost to meet the demand of the user.

In this arrangement, the operable angle and operating timing of the thigh support frame 9 can be easily set at low cost to meet a user's requirement.

Third Embodiment

Figure 6B:
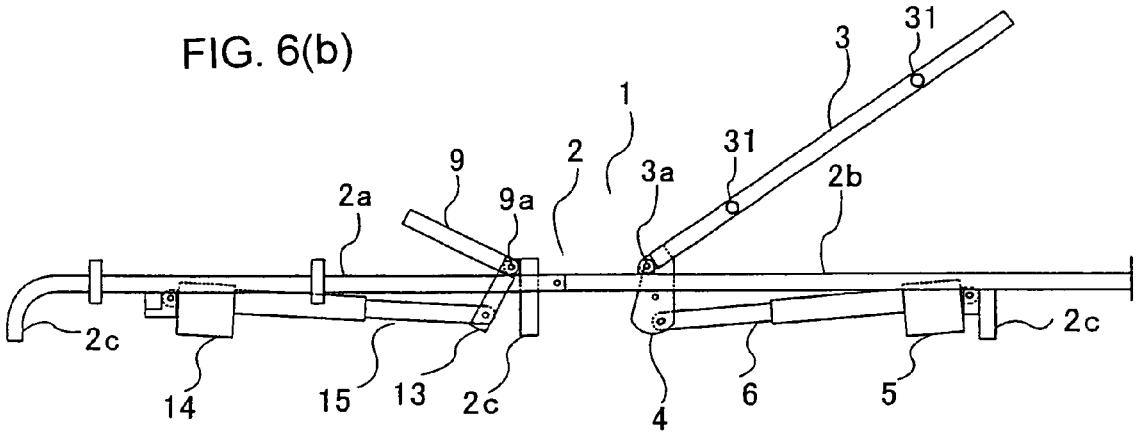
FIG. 6 shows a side elevation of a major section of a bed having a back lift mechanism in accordance with a third embodiment of the invention, showing details and functions of the major section.
Figure 6C:
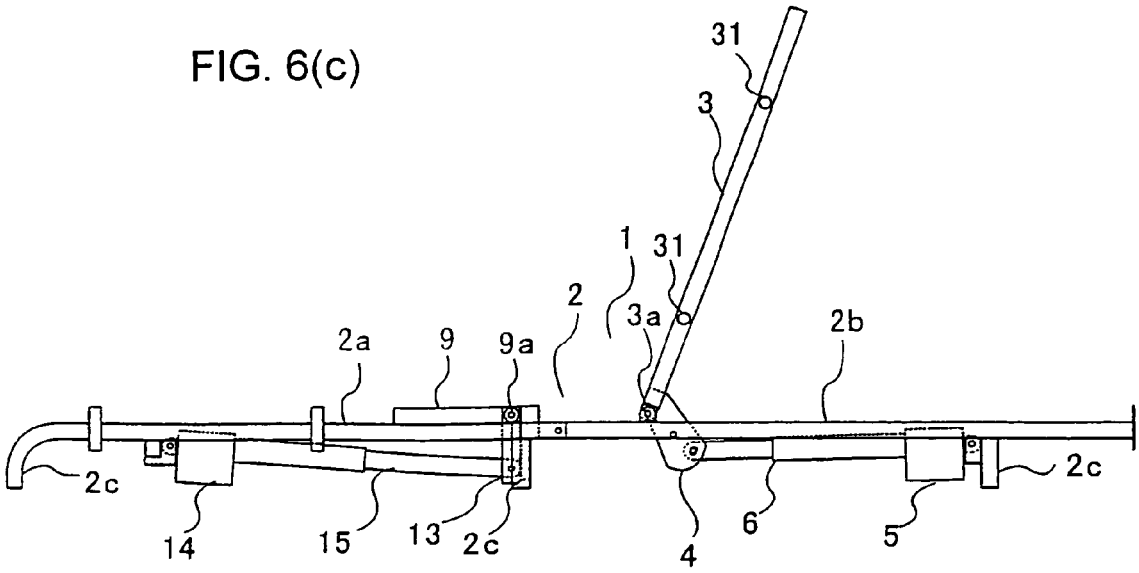

Referring to FIG. 6, there is shown a major portion and functions thereof of a bed having a back lift mechanism in accordance with a third embodiment of the invention, wherein the elements similar to or corresponding to those of the foregoing embodiments are indicated by like or corresponding reference numerals.

The embodiment shown herein employs a modified drive mechanism for the thigh support frame 9, which includes a thigh support drive arm 13 fixedly secured to one end of the thigh support frame 9, proximal to the rotary shaft 9*a*, and a linear actuator 15 adapted, as in the foregoing drive mechanism (linear actuator 6), to be advanced/retracted in the axial direction thereof to transmit the driving power of the driving power source, or motor 14, to the thigh support drive arm 13. This embodiment can provide substantially the same function as the foregoing embodiment by causing both the motors 5 and 14 to operate in the same manner as described in the foregoing embodiment using the microcomputer 8 shown in FIG. 1.

Fourth Embodiment

Figure 7A:
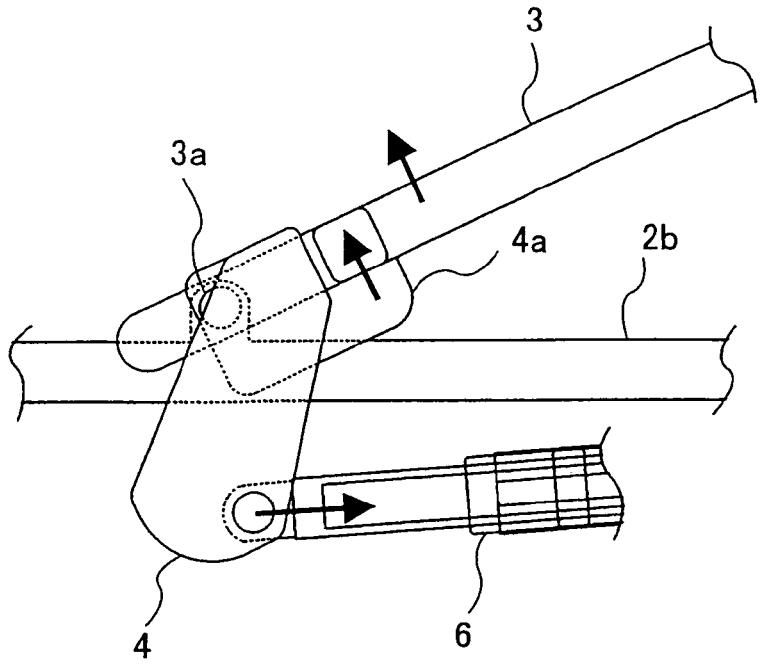
FIG. 7 shows in side elevation of a major section of the back lift frame drive mechanism of a bed having a back lift mechanism in accordance with a fourth embodiment of the invention, showing details and functions of the major section of the mechanism.
Figure 7B:
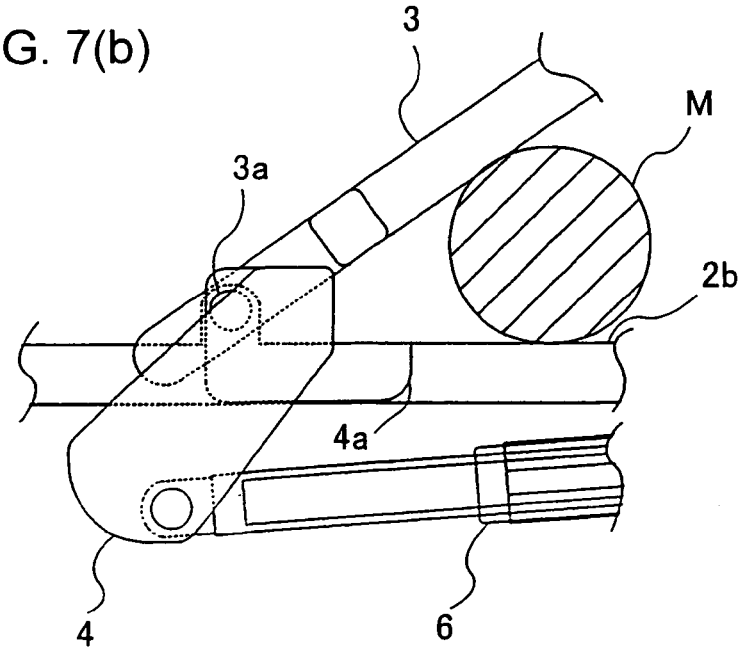

Referring to FIG. 7, there is shown a major portion and functions thereof of a back lift frame drive mechanism of a bed equipped with a back lift mechanism in accordance with a fourth embodiment of the invention, wherein the elements similar to or corresponding to those of the foregoing embodiments are indicated by like or corresponding reference numerals.

The back lift drive bracket 4 of this embodiment is provided with a drive frame 4*a* that is integrally fixed thereto and is coaxial with the rotary shaft 3*a* of the back lift frame 3. The drive frame 4*a* abuts against the underside of the back lift frame 3 near the rotary shaft 3*a* of the back lift frame 3, as shown in FIG. 7(*a*), to transmit to the back lift frame 3 the driving power of the back lift drive bracket 4 that is driven by the motor 5 via the linear actuator 6. This arrangement realizes a back lift frame drive mechanism (or back lift member drive mechanism) that can forcibly drive the back lift frame 3 only in the angularly positive direction.

In the arrangement described above, in a back lifting operation, the user of a bed or a care personnel operates a remote controller 7 to activate the motor 5 so as to contract the linear actuator 6, as already described above. Then the back lift drive bracket 4 connected to the leading end of the linear actuator 6 is rotated counterclockwise, as seen in FIG. 7(*a*). Then the drive frame 4*a* of the back lift drive bracket 4 abuts against the underside of the back lift frame 3 to forcible raise the back lift frame 3. To perform a reverse back lowering operation, the above-described process is reversed.

If, in the back lowering action, an obstacle M has come into the space between the back lift frame 3 and the bed frame 2 (head frame 2*b*) as shown in FIG. 7(*b*), no downward driving force will be applied by the linear actuator 6 to the back lift frame 3, since the back lift frame 3 only abuts against the drive frame 4*a*. Hence, the back lift frame 3 is lowered by the weights of the user, mattress, and the back lift frame 3 itself. Thus, safeguard against trapping an object by the back lift frame 3 in a back lowering operation will be secured by a comparatively simple mechanism.

Fifth Embodiment

Figure 8A:
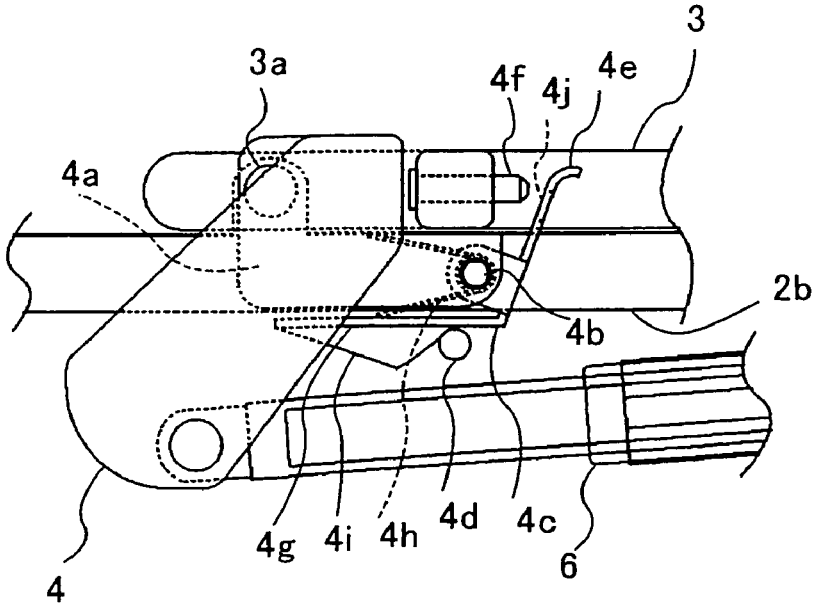
FIG. 8 shows in side elevation of a major section of the back lift frame drive mechanism of a back lift mechanism of a bed in accordance with a fifth embodiment of the invention, showing details and functions of the major section.
Figure 8B:
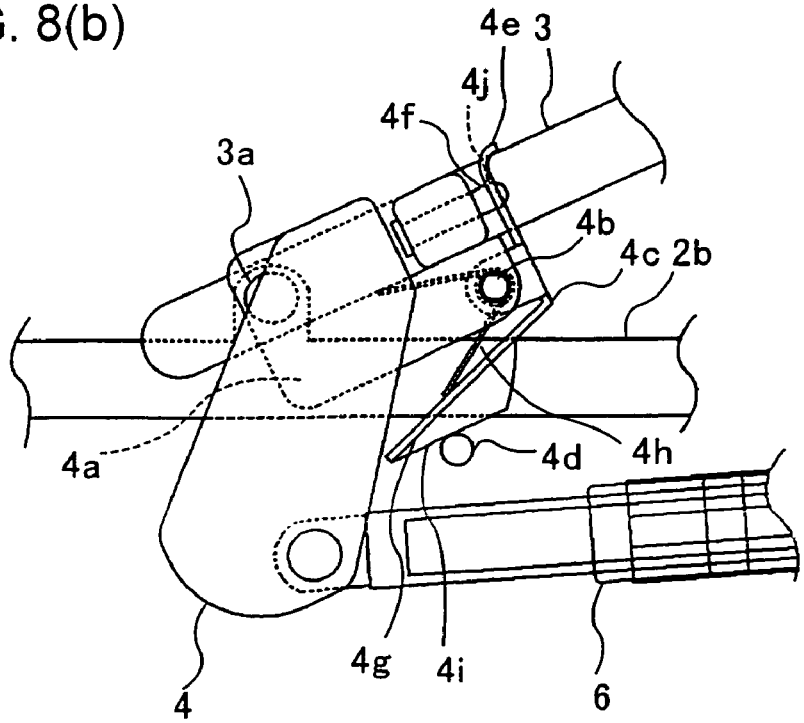

Referring to FIG. 8, there is shown a major portion and functions thereof of a back lift frame drive mechanism of a bed equipped with a back lift mechanism in accordance with a fifth embodiment of the invention, wherein the elements similar to or corresponding to those of the foregoing embodiments are indicated by like or corresponding reference numerals.

It is noted that in the back lift frame drive mechanism of the foregoing embodiment, if handrails are mounted on the handrail mounts 31 of the back lift frame 3, the handrails will be unstable and give the user anxiety, since the back lift frame 3 merely abuts at the underside thereof on the drive frame 4*a*.

Thus, in the example shown herein, there is provided, in addition to the back lift frame drive mechanism described above, a regulation fitting 4*c* that is made of a metal and has a section inflexed to an angle slightly larger than a right angle, with the inflexed section pivotally mounted on a rotary shaft 4*b* provided at one end (far right end as seen in FIG. 8) of the drive frame 4*a*. Provided beneath the regulation fitting 4*c* is a main frame pin 4*d* protruding from the main frame (head frame 2*b* of the bed frame 2). In addition, a stopper pin 4*f* is provided on the base of the back lift frame 3, formed to extend towards the rising section 4*e* of the regulation fitting 4*c*. Mounted on the rotary shaft 4*b* of the regulation fitting 4*c* is a twisted spring 4*h* for urging downward the lower section 4*g* of the regulation fitting 4*c*. Provided on the backside of the lower section 4*g* of the regulation fitting 4*c* is a triangular guide 4*i* having a steep slope and a gentle slope each configured to abut on the main frame pin 4*d*. On the other hand, formed in the rising section 4*e* is a hole 4*j* in which the stopper pin 4*f* can be fitted.

In this arrangement, in a back lifting operation, the back lift frame 3 is pushed upward by the drive frame 4*a*, while the regulation fitting 4*c* mounted on the drive frame 4*a* is moved, keeping a relationship with the stopper pin 4*f* of the back lift frame 3 as shown in FIG. 8(*a*). That is, because the guide 4*i* of the regulation fitting 4*c* maintains the relationship as shown in FIG. 8(*a*) in opposition to the restoring force of the twisted spring 4*h* until the back lift frame 3 is inclined to the preset lock angle of the main frame pin 4*d* positioned as shown, stopper pin 4*f* is then offset from the hole 4*j* of the regulation fitting 4*c*. Under such an angular condition as described above, if a back lowering operation is performed, the back lift frame 3 will not be forcibly driven downward, so that the safeguard is secured against trapping of an obstacle by the back lift frame 3 in back lowering action, as in the foregoing embodiment.

On the other hand, as the inclination of the back lift frame exceeds the preset lock angle as shown in FIG. 8(*b*), the regulation fitting 4*c* is rotated by the restoring force of the twisted spring 4*h* through the interaction between the guide 4*i* of the regulation fitting 4*c* and the main frame pin 4*d*, which causes the stopper pin 4*f* of the back lift frame 3 to be fitted in the hole 4*j* of the regulation fitting 4*c*, thereby interlocking the back lift frame 3 with the drive frame 4*a*. Under this condition, the handrails, if installed on the handrail mounts 31 of the back lift frame 3, have enhanced stability, since the back lift frame 3 is united to the drive frame 4*a*. It should be understood that the preset lock angle can be changed as desired by modifying the shape of the guide 4*i* and by adjusting the position of the main frame pin 4*d*.

Sixth Embodiment

Figure 9A:
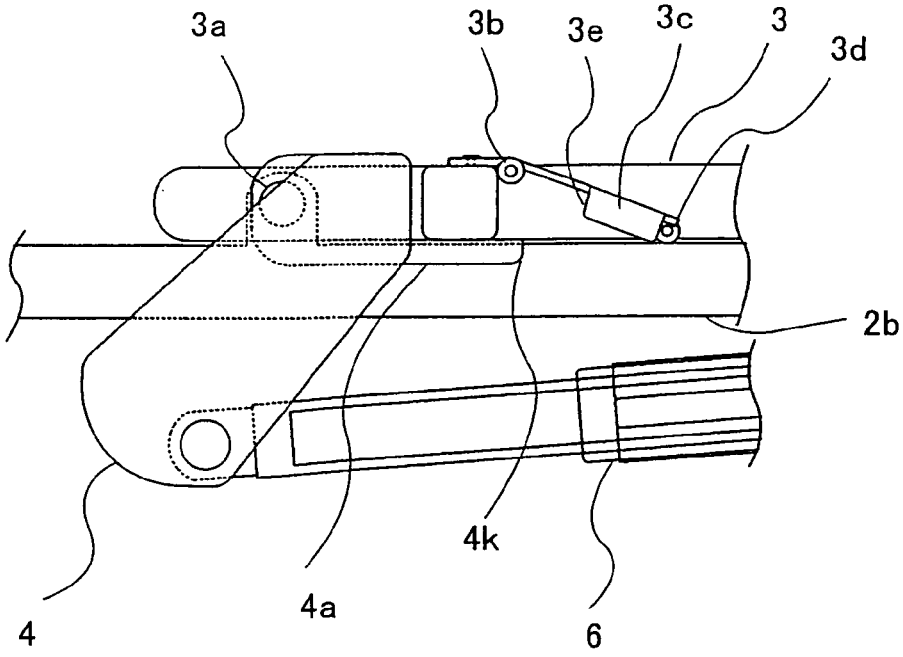
FIG. 9 shows in side elevation of a major section of the back lift frame drive mechanism of a back lift mechanism of a bed in accordance with a sixth embodiment of the invention, showing details and functions of the major section.
Figure 9B:
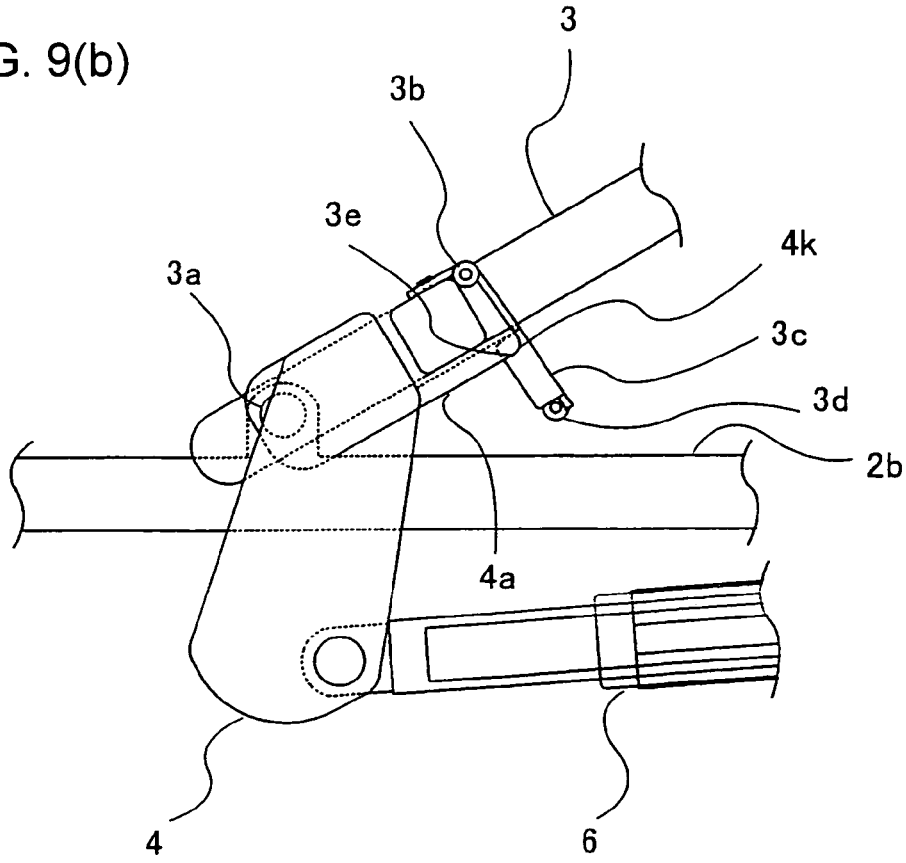

Referring to FIG. 9, there is shown a major portion and functions thereof of a back lift frame drive mechanism of a bed equipped with a back lift mechanism in accordance with a fifth embodiment of the invention, wherein the elements similar to or corresponding to those of the foregoing embodiments are indicated by like or corresponding reference numerals.

In this embodiment, there are provided, in addition to a back lift frame drive mechanism as described above, a lock part 3*c* pivotally connected, via a rotary shaft 3*b*, to the upper end of the base of the back lift frame 3, wherein the lock part 3*c* has at the lower end thereof a slide pin 3*d* adapted to slide on the main frame (head frame 2*b* of the bed frame 2), and has a shoulder 3*e* formed, at an intermediate point of the lock part 3*c*, to engage with the corner 4*k* of a drive frame 4*a*.

In this arrangement, until the back lift angle reaches the preset angle after the start of a back lifting operation, the slide pin 3*d* of the lock part 3*c* slides on the main frame (head frame 2*b* of bed frame 2), as shown in FIG. 9 (*a*), and hence the lock part 3*c* and the drive frame 4*a* are kept separated from each other, so that, if a back lowering action is performed, the back lift frame 3 will not be forcibly driven downward. Thus, the safeguard against trapping an obstacle will be secured in just the same way as in the foregoing embodiments.

On the other hand, if the back lift angle exceeds the preset lock angle, the slide pin 3*d* of the lock part 3*c* comes off the main frame (head frame 2*b* of bed frame 2) as shown in FIG. 9 (*b*), when the intermediate shoulder 3*e* of the lock part 3*c* engages the corner 4*k* of the drive frame 4*a*, thereby integrally unite and interlock the back lift frame 3 with the drive frame 4*a*. Under this condition, handrails, if installed on the handrail mounts 31 of the back lift frame 3, have enhanced stability, since the back lift frame 3 is united to the drive frame 4*a*. It should be understood that the preset lock angle can be changed as desired by changing the length of the lock part 3*c*.

Thus, a back lift mechanism according to either one of the embodiments shown in FIGS. 8 and 9 has a simple structure, yet it can secure safeguard against trapping of an obstacle by the back lift frame 3 in a back lowering operation and allows the user of the bed to take safe and comfortable actions to turn out of the bed, using stable handrails. This mechanism helps cared elderly people to take care of themselves, urges them to turn out of the beds for themselves, and suppresses the need for heavier nursing care.

Seventh Embodiment

Figure 10:
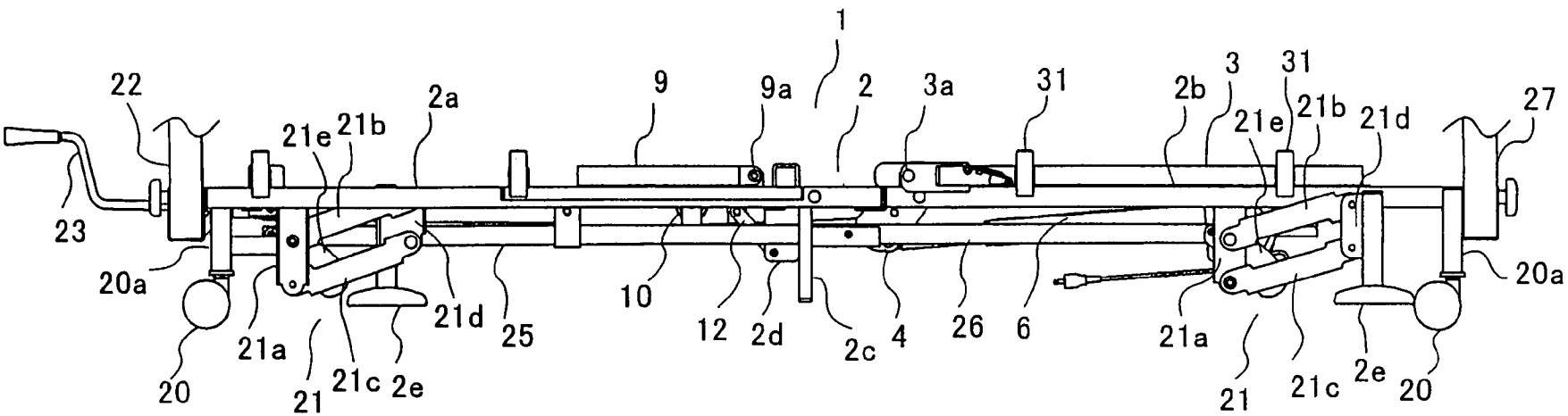
FIG. 10 shows a side elevation of a major section of a back lift mechanism of a bed in accordance with a seventh embodiment of the invention.
Figure 11:
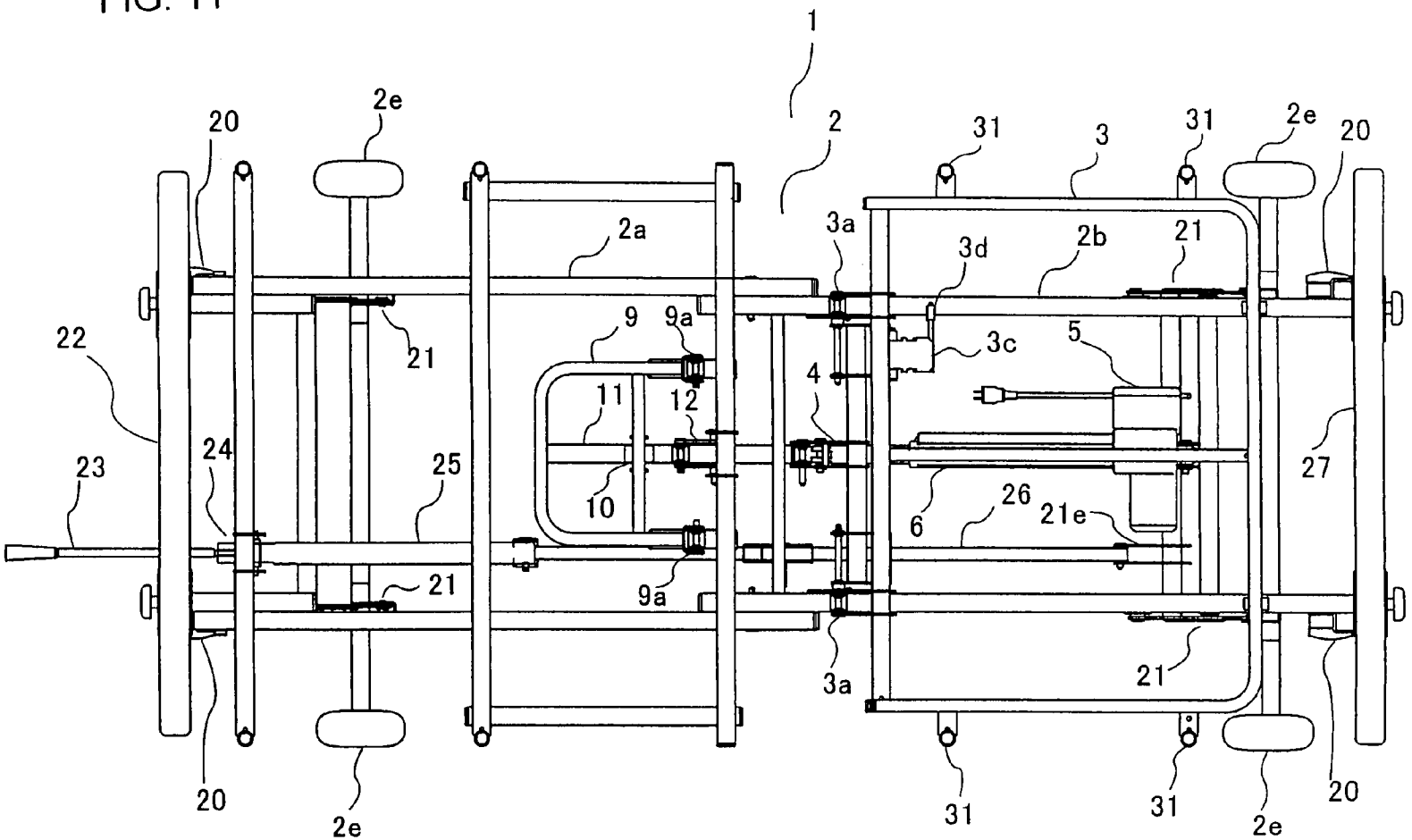
FIG. 11 is a plan view of the bed of FIG. 10.
Figure 12A:
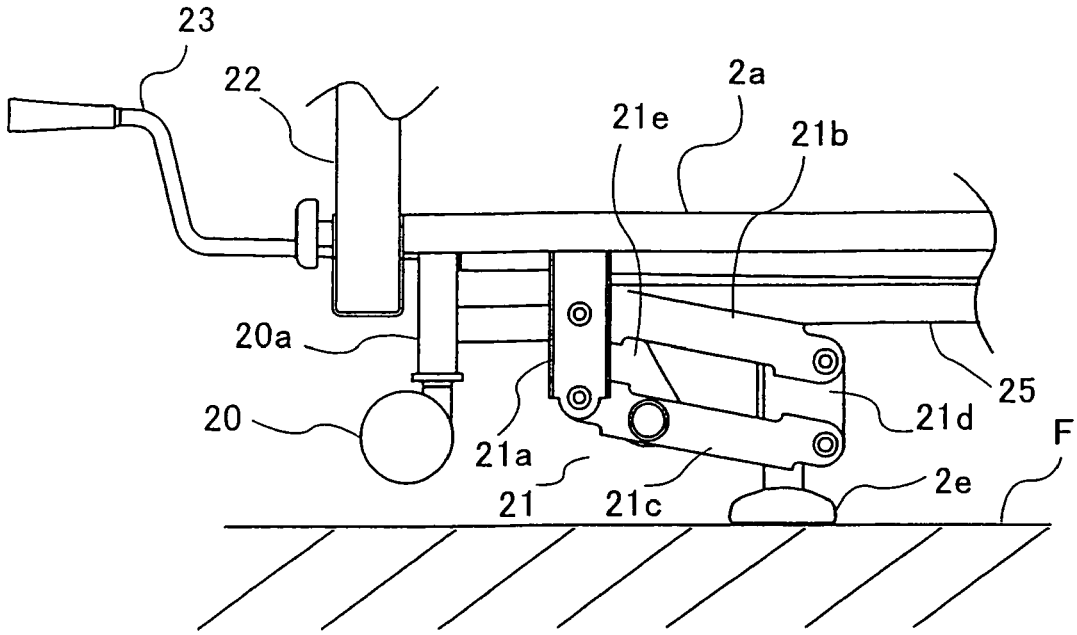
FIG. 12 is a fragmentary enlarged side view of the major section of FIG. 10, illustrating the operation of the major section.
Figure 12B:
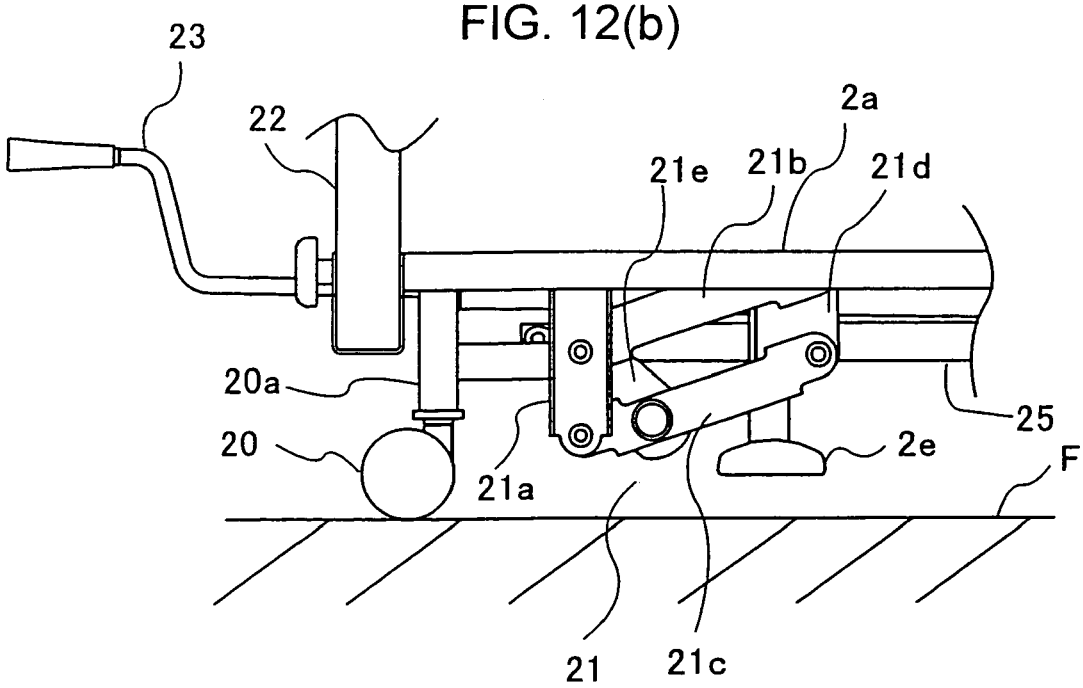

Referring to FIG. 10, there is shown in side elevation a major portion and functions thereof of a bed having a back lift mechanism in accordance with a seventh embodiment of the invention. FIG. 11 is a plan view of the bed. FIGS. 12(*a*) and (*b*) are fragmentary enlarged side views of the bed, altogether illustrating the operation of the bed. More particularly, FIGS. 12(*a*) and (*b*) respectively show a locked condition and a mobile condition of the bed, wherein the elements similar to or corresponding to those of the foregoing embodiments are indicated by like or corresponding reference numerals. It is noted that this embodiment utilizes a cooperative mechanism similar to the one shown in FIGS. 1-5 for the back lift frame 3 and the thigh support frame 9, and utilizes the lock part 3*c* shown in FIG. 9 as a back lift frame drive mechanism. However, various combinations of these components are also possible.

In this embodiment, there are provided, at four (i.e. front, rear, left, and right) corners of the bed frame 2, legs 2*e* for adjusting the height of the bed frame 2, and casters 20 provided at four (i.e. front, rear, left, and right) corners of the bed frame 2 and adapted to be grounded in place of the legs 2*e* when the bed frame 2 is lowered. These casters 20 can be inexpensive ones having no lock mechanism.

More particularly, each of the legs 2*e* provided at the four corners of the bed frame 2 and adjustable in height is attached to the bed frame 2 via a leg link mechanism 21 consisting of a 4-parallel-link mechanism. Specifically, each of the legs 2*e* is attached to the lower end of a link member 21*d* that faces a fixed link member 21*a* across upper and lower link members 21*b* and 21*c*, respectively. The fixed link member 21*a* projects downwardly from the bed frame 2.

On the other hand, mounted on the foot-side end of the bed frame 2 (end of foot frame 2*a*) is a ball-screw translational drive mechanism 24 that can be driven by a crank handle 23. A foot board 22 is mounted on the bed frame 2. Linked to the ball-screw translational drive mechanism 24 are a foot-side height adjustment rod 25 and a head-side height adjustment rod 26. Connected to the foot-side height adjustment rod 25 through a link member 21*e* is a lower link member 21*c* of the foot-side leg link mechanism 21. Connected to the head-side height adjustment rod 26 is another lower link member 21*c* of another head-side leg link mechanism 21 through another link member 21*e*.

As a consequence, the bed height can be adjusted as needed by turning a crank handle 23. It is noted that the height of the bed can be adjusted by an actuator similar to the motor-driven linear actuator 6 as described above.

On the other hand, each of the casters 20 provided at the four corners of the bed frame 2 is located inside a respective head board 27 mounted on the opposite side of the foot board 22, and attached to the lower end of a simple caster mount member 20*a* that projects downward from the bed frame 2.

In the arrangement described above, by turning the crank handle 23 in a predetermined direction, the ball-screw translational drive mechanism 24 is extended to force the foot-side and head-side height adjustment rods 25 and 26 towards the head-side (to the right as seen in FIG. 11). As a consequence, the leg link mechanisms 21 are rotated clockwise and relative to the fixed link member 21*a* as seen in FIGS. 10 and 12, thereby causing the legs 2*e* to extend downward to increase the height of the bed. Conversely, by turning the crank handle 23 in the opposite direction; the ball-screw translational drive mechanism 24 is contracted, thereby decreasing the bed height.

FIG. 12(*a*) shows the bed in a fixed (or immobile) condition. That is, the legs 2*e* are grounded on the floor F while the casters 20 are lifted to a level higher than the legs 2*e*, and hence off the floor, to make the bed immobile.

On the other hand, FIG. 12(*b*) shows the mobile condition of the bed, in which the bed can move using the casters 20. That is, through adjustment of the bed height as described above, the bed can be brought to the lowest level, causing the casters 20 to be grounded to the floor F and the legs 2*e* being offset from the floor.

As described above, in this embodiment, the low cost casters 20 having no lock mechanism are mounted on the bed frame 2, not on the legs 2*e*, by means of simple caster mount members 20*a*. In moving the bed, the height of the bed is decreased by turning the crank handle 23 until the casters touch the floor, thereby lifting the legs 2*e* off the floor to make the bed movable. On the other hand, in order to fix the bed on the floor, the height of the bed is increased to some extent through adjustment of the bed height, thereby lifting the casters 20 above the floor and allowing the legs 2*e* to touch the floor. Thus, the casters are grounded when the bed needs to be moved, while the legs are grounded when the bed is used for ordinary purposes.

Thus, according to the embodiment described above, a bed can be provided which is simple in structure, inexpensive, yet easily movable by casters 20 while keeping the height of the bed low to avoid giving the user a fear of height or a risk of serious injury in a fall from the bed. Further, a possibility that an attendant forgets to lock casters can be eliminated. A risk of a fall of the user trying to move from the bed to a wheelchair or turn out of the bed can be also eliminated.

The invention claimed is:

1. A bed, comprising:

a bed frame comprising a head frame corresponding to an upper body of a user above a waist and a foot frame corresponding to a lower body of the user below the waist;

a back lift member provided on said head frame of said bed frame, an end of said back lift member nearest to said foot frame being rotatably connected to said bed frame;

a thigh support mechanism provided on said foot frame of said bed frame, said thigh support mechanism having a thigh support member for supportively lifting only the thighs of the user, an end of said thigh support member nearest to said head frame being pivotally mounted on said foot frame of said bed frame, and said thigh support member having a width smaller than said back lift member and being provided at the center of the width of said bed frame.

2. The bed according to claim 1, further comprising cooperative means for performing a thigh lifting action of the thigh support mechanism in cooperation with said back lift member in back lifting action.

3. The bed according to claim 1, wherein said cooperative means cooperates with said back lift member in back lifting action to perform a thigh support action of said thigh support mechanism, and a thigh lowering action of said thigh support mechanism that is started in the middle of said back lifting action to return said thighs to a flat position.

4. The bed according to claim 1, further comprising:

a back lift drive member fixedly secured to one end of said back lift member, said end proximal to a rotary shaft of said back lift member;

a drive mechanism for transmitting the driving power of a driving power source to said back lift drive member;

a thigh support member drive rod having one end pivotally mounted on said back lift drive member and the other end abutting on a roller provided on the underside of said thigh support member; and a rod support member having a lower end pivotally connected to said bed frame and an upper end pivotally connected to an intermediate point of said thigh support member drive rod.

5. The bed according to claim 4, wherein an operational angle and operational timing of said thigh support member are adjustable by said thigh support member drive rod having a preferred configuration on the abutting surface thereof in abutment with said roller mounted on the underside of said thigh support member.

6. The bed according to claim 1, further comprising:

a back lift member having a waist side end pivotally mounted on said bed frame for performing back lifting action;

a back lift drive member fixedly secured to one end of said back lift member, said end proximal to a rotary shaft of said back lift member;

a drive mechanism for transmitting the driving power of a first driving power source to said back lift drive member;

a thigh support drive member fixedly secured to one end of said thigh support member, said end proximal to the rotary shaft said thigh support member; and a drive mechanism for transmitting the driving power of a second driving power source to said thigh support member.

7. The bed according to claim 1, further comprising:

a back lift member having a waist side end pivotally mounted on said bed frame for performing back lifting action; and a back lift member drive mechanism capable of forcibly driving said back lift member only in the direction in which the angle of said back lift member with respect to the bed frame increases (the direction hereinafter referred to as angularly forward direction).

8. The bed according to claim 1, further comprising:

a back lift member having a waist side end pivotally mounted on said bed frame for performing back lifting action; and a back lift member drive mechanism for forcibly driving said back lift member only in the angularly forward direction with respect to said bed frame while the back lift angle of said back lift member is less than a preset angle, and capable of forcibly driving said back lift member in the angularly forward direction and angularly backward direction as well when the back lift angle exceeds said preset angle.

9. The bed according to claim 1, further comprising:

legs mounted on a height adjustment mechanism of said bed frame; and casters mounted on said bed frame such that said casters are grounded in place of said legs when said bed frame has a low level.

* * * * *